United States Patent [19]

Vasapolli

[11] Patent Number: 4,736,935

[45] Date of Patent: Apr. 12, 1988

[54] VICE

[76] Inventor: Santo Vasapolli, P.O. Box 10230, Fonteinriet, 1464, South Africa

[21] Appl. No.: 2,724

[22] Filed: Jan. 13, 1987

[30] Foreign Application Priority Data

Jan. 16, 1986 [ZA] South Africa ..... 86/0334

[51] Int. Cl.[4] ..... B25B 1/12

[52] U.S. Cl. ..... 269/137; 269/210; 269/172; 269/282

[58] Field of Search ..... 269/134–138, 269/139, 164, 167, 172, 207, 210, 282

[56] References Cited

U.S. PATENT DOCUMENTS

| | | | |
|---|---|---|---|
| 381,890 | 4/1888 | Taylor . | |
| 540,413 | 6/1895 | Vanderbeck | 269/137 |
| 2,584,062 | 1/1952 | Stone . | |
| 2,667,799 | 2/1954 | Rzepela | 269/138 |
| 2,861,492 | 11/1958 | Hokanson . | |
| 2,992,665 | 7/1961 | Mertz | 269/137 |
| 3,565,417 | 2/1971 | Degle . | |
| 3,630,512 | 12/1971 | Paret | 269/172 |
| 3,682,467 | 8/1972 | Heinrich | 269/137 |
| 4,489,927 | 12/1984 | Yamada et al. | 269/137 |

FOREIGN PATENT DOCUMENTS

| | | | |
|---|---|---|---|
| 52379 | 11/1981 | European Pat. Off. . | |
| 1121559 | 2/1957 | Fed. Rep. of Germany . | |
| 1155070 | 4/1957 | Fed. Rep. of Germany . | |
| 1181647 | 11/1964 | Fed. Rep. of Germany . | |
| 1807060 | 6/1969 | Fed. Rep. of Germany . | |
| 2044065 | 3/1972 | Fed. Rep. of Germany . | |
| 2318147 | 10/1974 | Fed. Rep. of Germany . | |
| 2447243 | 11/1976 | Fed. Rep. of Germany . | |
| 1443185 | 4/1965 | France | 269/210 |
| 1693 | of 1903 | United Kingdom | 269/210 |
| 636520 | 5/1950 | United Kingdom . | |

*Primary Examiner*—Robert C. Watson

*Attorney, Agent, or Firm*—Pravel, Gambrell, Hewitt, Kimball & Krieger

[57] ABSTRACT

A vice 10 includes an elongate base 12 having a first jaw 14 comprising a body portion 16 which is integrally formed with the base 12. A clamping portion 17 of the first jaw defines a first clamping surface 18. The clamping portion 17 is adjustable relative to the body portion 16 of the first jaw 14. A second jaw 20 comprises a body portion 24 and a clamping portion 26 defining a second clamping surface 22. The body portion 24 of the second jaw 20 is slidable along the base 12 and can be locked relative to the base 12. The clamping portion 26 is slidable relative to the body portion 24 along an inclined plane. An elongate bolt-like element 56 is provided for displacing and locking the clamping portion 26 relative to the body portion 24.

11 Claims, 4 Drawing Sheets

VICE

FIELD OF THE INVENTION

This invention relates to a vice, in particular a vice for use on a machine tool.

SUMMARY OF THE INVENTION

According to the invention, there is provided a vice which includes a base;

a first jaw projecting from the base, the first jaw having a first clamping surface extending transversely to the base;

a second jaw which comprises a body portion fast with the base, and a clamping portion, the clamping portion defining a second clamping surface aligned with, and opposed to the first clamping surface of the first jaw, the clamping portion and the body portion of the second jaw having substantially planar mating surfaces which define an inclined plane along which the clamping portion can slide relative to the body portion, the inclined plane extending from the base in a direction away from the first jaw such that the spacing between the first and second clamping surfaces may be varied by displacing the clamping portion relative to the body portion; and a displacement means for exerting a displacing force on the clamping portion which is directed towards and substantially perpendicular to the base for displacing the clamping portion of the second jaw towards the base and thereby causing the clamping portion to be displaced towards the first jaw into an operative position in which a workpiece is securely gripped between the first clamping surface and the second clamping surface.

The body portion of the second jaw may be displaceably fast with the base, and the body portion may include a locking means for locking the second jaw at a desired position on the base, the base having complementary locking formations with which the locking means of the body portion is releasably engageable.

The locking means may include a pair of transversely spaced saw-tooth formations extending from the body portion of the second jaw towards the base, and the locking formations of the base may include a pair of transversely spaced strips of complementary saw-tooth formations engageable by the saw-tooth formations of the body portion of the second jaw.

The body portion of the second jaw may include a first urging means for urging the saw-tooth formations of the body portion of the second jaw out of engagement with the saw-tooth formations of the base.

The base may be elongate having a substantially centrally located channel extending longitudinally along the base intermediate the strips of saw-tooth formations.

The displacement means may include an elongate bolt-like element having a head portion which is held slidably captive in the channel of the base, and a shank which extends from the head portion through aligned bores in the body portion and the clamping portion of the second jaw to project beyond the clamping portion of the second jaw, at least that portion of the shank projecting beyond the second jaw being screw-threaded with a nut received on the screw-threaded portion of the shank, the nut bearing via a washer on the clamping portion of the second jaw.

The second jaw may include a second urging means for urging the clamping portion of the second jaw away from the base, the nut of the displacement means, in use, acting against the action of the second urging means to displace the clamping portion towards the base and into its operative position.

The displacement means may serve to urge the saw-tooth formations of the body portion of the second jaw into engagement with the strips of saw-tooth formations of the base against the action of the first urging means.

The saw-tooth formations of the body portion of the second jaw and the strips of saw-tooth formations of the base may be in the form of replaceable inserts.

Teeth of the strips of saw-tooth formations of the base may be arranged at an angle relative to the base to facilitate removal of debris which may collect between the teeth, with teeth of the saw-tooth formations of the body portion of the second jaw being correspondingly angled.

The clamping surface of the first jaw may be defined by a clamping portion which is displaceably attached to a body portion of the first jaw, the said clamping portion being displaceable both normal to, and parallel with, the base.

The first jaw may include an adjustment means for facilitating the displacement of the clamping portion of the first jaw to effect adjustment of the position of the workpiece between the jaws.

The adjustment means may include a pair of transversely spaced threaded bolts extending through bores in the body portion of the first jaw into threaded sockets in the clamping portion of the first jaw to facilitate the displacement of the clamping portion parallel to the base.

The adjustment means may further include a threaded stud, the longitudinal axis of which is arranged substantially normal to the longitudinal axes of the threaded bolts, the stud extending into a threaded bore in the body portion of the first jaw, and a nut bearing against a washer being screw-threadedly received on a free end of the stud projecting beyond the body portion, with the washer bearing against a bearing surface of the clamping portion against the action of a third urging means to facilitate the displacement of the clamping surface of the first jaw normal to the base.

The body portion of the first jaw may be formed integrally with the base.

The invention extends also to a vice which includes an elongate base having a pair of transversely spaced strips of saw-tooth formations, and a substantially centrally located channel intermediate the strips;

a first jaw projecting from the base, the first jaw having a first clamping surface extending transversely to the base;

a second jaw which is hand manipulatable to be displaced along the base and which comprises a body portion and a clamping portion defining a second clamping surface aligned with, and opposed to the first clamping surface of the first jaw, the clamping portion and the body portion of the second jaw having mating planar surfaces which define an inclined plane along which the clamping portion can slide relative to the body portion, the inclined plane extending from the base in a direction away from the first jaw such that the spacing between the first and second clamping surfaces may be varied by displacing the clamping portion relative to the body portion;

a pair of transversely spaced saw-tooth formations extending from the body portion of the second jaw for releasably engaging the strips of saw-tooth formations on the base; and an elongate bolt-like element having a head portion which is held slidably captive in the channel of the base, and a shank which extends from the head portion through aligned bores in the body portion and the clamping portion of the second jaw to project beyond the clamping portion of the second jaw, at least that portion of the shank projecting beyond the second jaw being screw-threaded with a nut received on the screw-threaded portion of the shank, the nut bearing via a washer on the clamping portion of the second jaw, tightening of the nut, in use, displacing the clamping portion of the second jaw towards the base into an operative position in which a workpiece is securely gripped between the first clamping surface and the second clamping surface, and the tightening of the nut also serving to urge the saw-tooth formations of the body portion of the second jaw into engagement with the strips of saw-tooth formations of the base for locking the second jaw at a desired position on the base.

BRIEF DESCRIPTION OF THE DRAWINGS

The invention is now described by way of example with reference to the accompanying drawings in which.

DETAILED DESCRIPTION OF THE DRAWINGS

Figure 1:
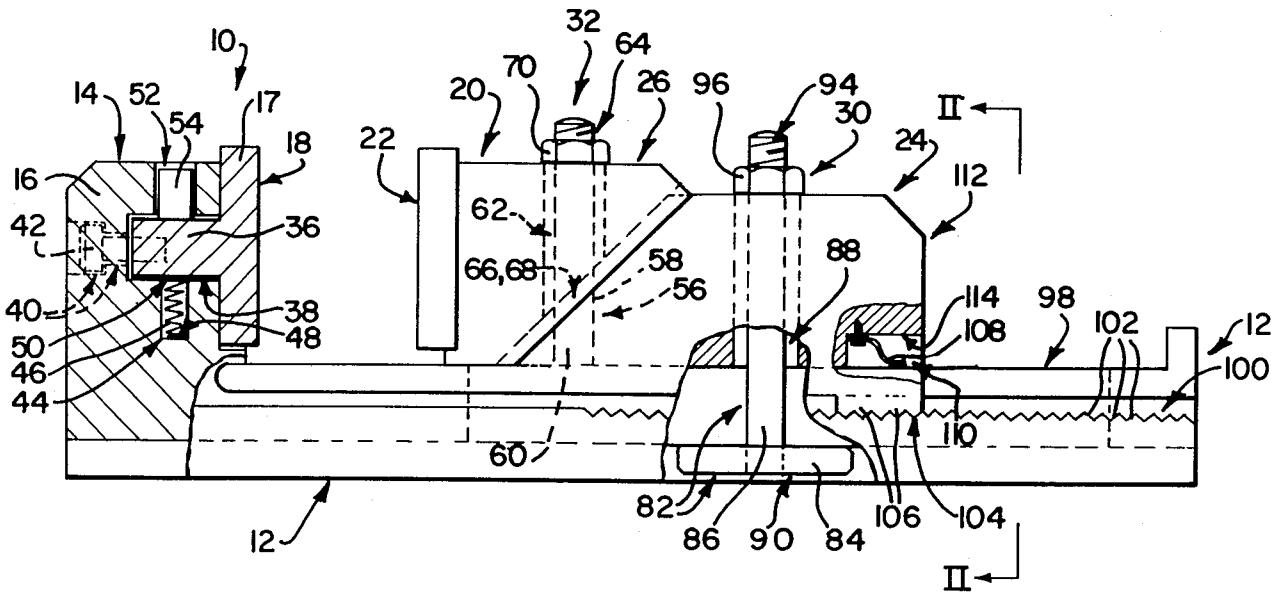
FIG. 1 is a partly sectioned side view of a vice according to one embodiment of the invention.
Figure 2:
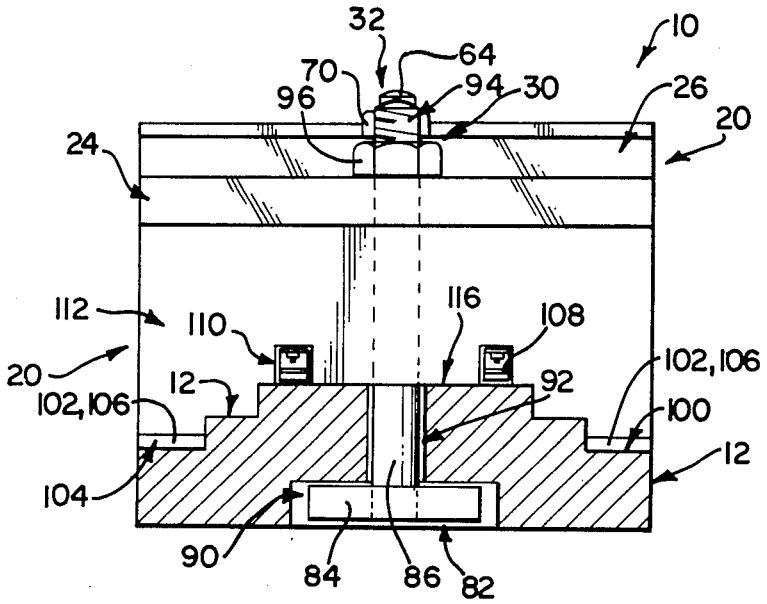
FIG. 2 is a sectional end view of the vice of FIG. 1 taken along II—II through FIG. 1.
Figure 3:
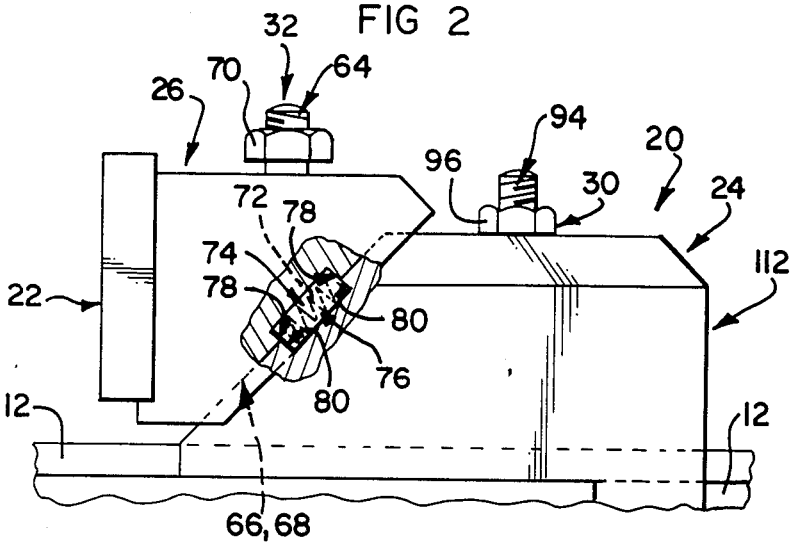
FIG. 3 is a partly sectioned side view of a second jaw of the vice of FIG. 1.

With reference to FIGS. 1 to 3, reference numeral 10 generally indicates a vice according to the invention.

The vice 10 includes an elongate base 12, and a first jaw 14 having a body portion 16 formed integrally with the base 12 and a clamping portion 17 defining a first clamping surface 18.

A second jaw 20 is slidably displaceable along the base 12. The second jaw 20 comprises a body portion 24 and a clamping portion 26 which defines a second clamping surface 22 which is aligned with, and opposed to the first clamping surface 18. The body portion 24 of the second jaw 20 is displaceable with respect to the base 12 to vary the distance between the first clamping surface 18 and the second clamping surface 22.

The vice 10 also includes a releasable locking means 30 for releasably locking the second jaw 20 to the base 12 at a selected distance from the first jaw 14 so as to inhibit displacement of the second jaw 20 with respect to the first jaw 14; and a displacement means 32 for displacing the second clamping surface 22 of the second jaw 20 in a direction towards the base 12 when it is locked to the base 12.

As described above, the fist jaw 14 comprises two separable parts, i.e. a clamping portion 17 which defines the first clamping surface 18 and a body portion 16 formed integrally with the base 12. The clamping portion 17 has a locating projection 36 which is received in a locating socket 38 in the body portion 16. The body portion 16 defines a bore 40 co-axial with the socket 38, and a screw 42 which extends from the bore 40 into the locating projection 36 of the clamping portion 17 and secures the clamping portion 17 and the body portion 16 together.

The body portion 16 further defines a bore 44 at right angles to the socket 38, which extends from the socket 38 towards the base 12. A biassing means in the form of a helical spring 46 is located in the bore 44 and its ends abut a biassing surface 48 of the body portion 16 and a side wall 50 of the clamping portion 17 respectively, to bias the clamping portion 17 away from the base 12. As can be seen from FIG. 1, the extent to which the clamping portion 17 can be displaced towards or away from the base 12 is limited and is dependent upon the width of the locating socket 38.

An access passage 52 for an urging member in the form of a screw 54 is provided through the body portion 16 in communication with the socket 38 and the exterior respectively, and substantially co-axial with the bore 44. The access passage 52 is internally screw-threaded and the screw 54 is receivable in the passage 52 and is linearly displaceable towards and away from the base 12 to urge the clamping portion 17 towards the base 12 and to release it respectively.

The clamping portion 26 of the second jaw 20 is reciprocally displaceable with respect to the body portion 24 towards and away from the base 12 and the first jaw 14.

The body portion 24 and the clamping portion 26 are held in register with each other by means of the displacement means 32. The displacement means 32 comprises an elongate bolt-like element 56 having a shank 58, a portion 60 of which is fast with the body portion 24. The shank 58 extends through a bore 62 of the clamping portion 26. The free end portion 64 of the element 56 projects upwardly from the top of the clamping portion 26 and this portion 64 has an external screw-thread.

The clamping portion 26 and the body portion 24 have substantially planar inclined surfaces 66 and 68 respectively which define an inclined plane along which the clamping portion 26 can slide relative to the body portion 24, the inclined surfaces 66, 68 extending from the base 12 in a direction away from the first jaw 14. The displacing means 32 also comprises an internally screw-threaded displacing nut 70 locatable on the end portion 64 of the element 56. The nut 70 is manually displaceable downwardly along the element 56 to displace the clamping portion 26 and hence the mating surface 66 downwardly with respect to the body portion 24 and the surface 68.

The second jaw 20 includes an urging means for biassing the clamping portion 26 upwardly with respect to the body portion 24, i.e., in a direction away from the base 12 and the first jaw 14. The urging means comprises a pair of transversely spaced helical springs 72 (only one of which is shown in FIG. 3, the other spring being aligned therewith).

The surfaces 66 and 68 define a pair of transversely spaced recesses 74 and 76 repsectively. When the vice 10 is not being used, i.e., when the clamping portion 26 of the second jaw 20 is in its inoperative position raised off the base 12, the recesses 74, 76 of the surface 66 will be aligned with the recesses 76 of the surface 68 to define a pair of transversely spaced cavities in the second jaw 20 to accommodate the springs 72. Each of the end walls of the cavities provide biassing walls 78 and 80 of the clamping portion 26 and the body portion 24 respectively. When the clamping portion 26 is displaced downwardly by tightening the displacing nut 70 on the element 56, the springs 72 are compressed as the recesses 74, 76 become misaligned. Accordingly when the nut 70 is loosened, the springs 72 urge the clamping portion 26 upwardly, away from the base 12 to re-align the recesses 74, 76.

The body portion 24 is connected, in use, to the base 12 via the locking means 30 which comprises a connecting member in the form of a bolt 82. A head 84 of the bolt 82 provides a base part of substantially square section, and a shank 86 of the bolt extends through a bore 88 in the body portion 24. The bore 88 is disposed at right angles to the longitudinal axis of the base 12.

The base 12 of the vice 10 has a longitudinally extending channel 90 running transversely to the clamping surface 18 of the first jaw 14. The bolt head 84 is held captive in the channel 90 and is slidable along it, and the shank 86 projects upwardly therefrom through an access slot 92 in the base 12 of the vice 10.

The free end portion 94 of the shank 86 projects from an upper surface of the body portion 24 and is externally screw-threaded. A screw-threaded lock nut 96 is receivable on and displaceable along the shank 86 to lock the body portion 24 to the base 12.

The upper surface of the base 12 along which the second jaw 20 is displaceable is stepped as can be seen in FIG. 2. The two outermost longitudinally extending steps define bearing surfaces 100 having transverse saw-tooth formations 102 or alternative displacement inhibiting formations which are provided in the form of longitudinally extending strips. Similarly, the under surface of the body portion 24 which engages the base 12 in use is stepped in a complementary fashion to the upper surface of the base 12, as can be seen in FIG. 2. A portion of the two outermost longitudinally extending steps define bearing surfaces 104 having transverse saw-tooth formations 106 or alternative displacement inhibiting formations complementary to those of the bearing surfaces 100 of the base 12.

When the lock nut 96 is tightened, the saw-tooth formations 106 on the bearing surfaces 104 of the body portion 24 engage the saw-tooth formations 102 of the bearing surfaces 100 of the base 12 and inhibit displacement of the body portion 24 with respect to the base 12.

The second jaw 20 includes an urging means in the form of a pair of transversely spaced leaf springs 108 for urging the body portion 24 away from the base 12.

Recesses 110 in a rear wall 112 of the body portion 24 accommodate the springs 108, and the respective upper surfaces 114 of the recesses 110 provide biassing surfaces for the springs 108, while the uppermost portion 116 of the engaging surface of the base 12 provides an opposed biassing surface therefor.

When the lock nut 96 is tightened and the body portion 24 is displaced downwardly toward the base 12, the springs 108 are compressed. Accordingly, when the nut 96 is loosened, the springs 108 urge the body portion 24 away from the base 12.

For use, the clamping portion 17 of the first jaw 14 is secured to the body portion 16 of the jaw 14 and is urged away from the base 12 by the spring 46. The clamping portion 26 of the second jaw 20 is in an inoperative position in which it is clear of the base 12, as shown in FIG. 3. The recesses 74 and 76 are aligned with each other, and the springs 72 are in a relatively uncompressed condition. The lock nut 96 is in its loosened configuration so that the second jaw 20 is slidably displaceable with respect to the base 12 towards and away from the first jaw 14.

In use, a selected workpiece (not shown) is placed against the clamping surface 18 of the first jaw 14 and second jaw 20 and is lightly clamped between the first and second clamping surfaces 18, 22 by sliding the second jaw 20 along the base towards the first jaw 14. The second jaw 20 is then locked in this position by tightening the nut 96. The clamping portion 17 of the first jaw 14 is urged towards the base 12 by tightening the screw 54 onto the projection 36 of the clamping portion 17 of the first jaw 14. The second clamping surface 22 is urged towards the first jaw 14 and the base 12 by tightening the displacing nut 70 and thereby displacing the clamping portion 26 of the second jaw 20 downwardly with respect to the body portion 24.

To release the workpiece, the displacing nut 70 is loosened sufficiently to permit the springs 72 to urge the clamping portion 26 upwardly with respect to the body portion 24 and away from the base 12 and the first jaw 14. The lock nut 96 is loosened and the springs 108 urge the saw-tooth formations 106 of the body portion 24 out of engagement with the saw-tooth formations 102 of the base 12 to permit the second jaw 20 to be displaced with respect to the base 12 away from the first jaw 14. Finally the screw 54 of the clamping portion 17 of the first jaw 14 is released and the spring 46 urges the clamping portion 17 away from the base 12.

Figure 4:
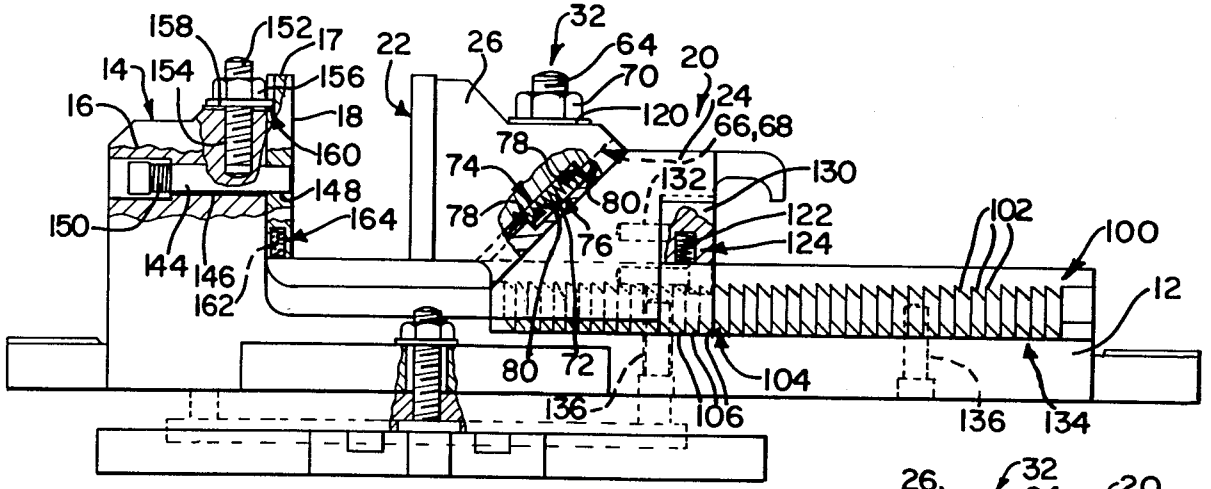
FIG. 4 is a partly sectioned side view of a vice according to another embodiment of the invention.
Figure 6:
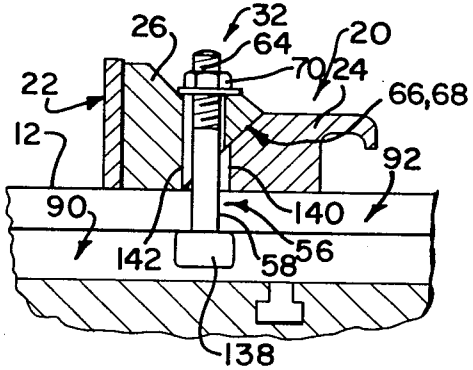
FIG. 6 is a sectioned side view of a second jaw of the vice of FIG. 4.
Figure 5:
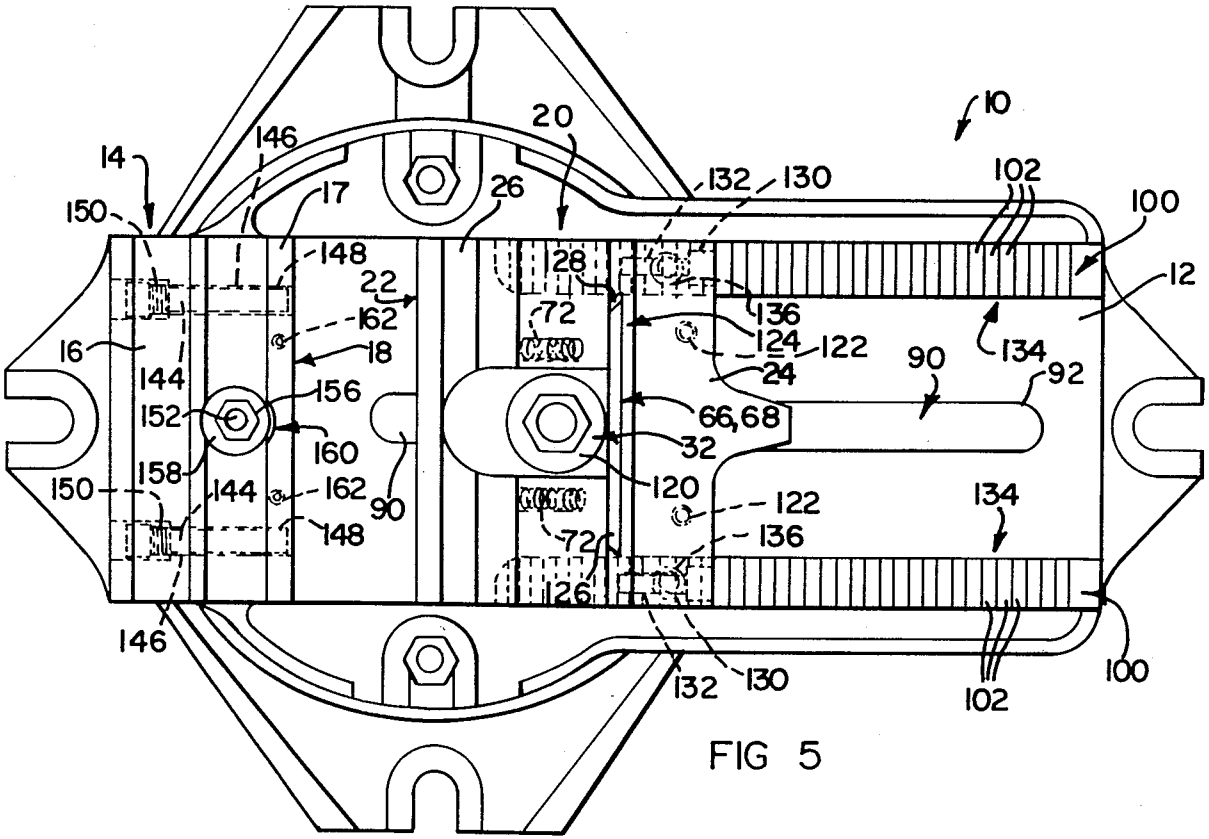
FIG. 5 is a plan view of the vice of FIG. 4.

Referring now to FIGS. 4 to 6, a vice in accordance with another embodiment of the invention is illustrated. With reference to FIGS. 1 to 3, like reference numerals refer to like parts unless otherwise specified.

In this embodiment of the invention, the displacement means 32 serves to displace the clamping portion 26 relative to the body portion 24 of the second jaw 20, as well as to guide the second jaw 20 along the channel 19 in the base 12 of the vice 10. Further, the displacement means 32 serves to urge the saw-tooth formations 106 of the body portion 24 into engagement with the strips of saw-tooth formations 102 on the base 12. The nut 70 bears against a washer 120 which in turn bears against an upper surface of the clamping portion 26 of the second jaw 20. When the nut 70 is tightened to urge the clamping portion 26 towards the base 12, the nut acts against the pair of transversely spaced helical springs 72. To lock the body portion 24 of the second jaw 20 in position on the base 12, tightening of the lock nut 70 acts against a pair of transversely spaced helical springs 122 provided in recesses 124 near a rear portion of the body portion 24 of the second jaw 20. When the nut 70 is loosened, the clamping portion 26 is raised relative to the body portion 24 under the action of the helical springs 72. Similarly, the saw-tooth formations 106 of the body portion 24 are raised out of engagement with the saw-tooth formations 102 of the base 12 under the action of the springs 122.

In this embodiment, the mating planar surfaces 66, 68 are formed by a planar portion of a dovetailed joint 124 (FIG. 5) between the clamping portion 26 and the body portion 24 of the second jaw 20. The dovetail portion 126 which is formed integrally with the clamping portion 24 of the second jaw 20 fits in a suitably shaped recess in the body portion 24. The dovetail 126 fits with clearance in the recess of the body portion 24 to leave a space between a side portion of the recess and a side of the dovetail 126. This space defines a keyway in which a suitably shaped key 128 is inserted to lock the clamping portion 26 against lateral displacement relative to the body portion 24 of the second jaw 20.

The saw-tooth formations 106 of the body portions are provided as replaceable inserts 130. The inserts 130 are bolted to the body portion by means of bolts 132. Similarly, the strips of saw-tooth formations 102 which are provided on the base 12, are provided as removable inserts 134. The inserts 134 are secured to the base by means of bolts 136. In use, the saw-tooth formations 102 and 106 become worn. Hence, with the provision of the inserts 130 and 134, these formations 102 and 106 can be easily replaced. The saw-tooth formations 102 of the base 12 are angled relative to the horizontal so that any debris such as metal filings can easily be removed from between the teeth of the formations 102 eg. by being washed with water which is used to cool a workpiece on which a metal working operation is being performed. The saw-tooth formations 106 of the body portion 24 are correspondingly angled.

Typically, the pitch of the teeth of the formations 102 and 106 is about 6mm, and the clamping portion 26 of the second jaw 20 can be displaced about 10mm parallel to the base 12. Hence, a wide range of adjustment can be achieved between the clamping surfaces 18 and 22 of the vice 10.

Referring to FIG. 6, the bolt-like element 56 has a head 138 which is held captive in the channel 90 in the base 12. The shank 58 extends through the slot 92 in the base, through a bore 140 in the body portion 24 and an aligned bore 142 in the clamping portion 26. Hence, the bolt-like element 56 serves to guide the second jaw 20 along the base by means of the shank 58 of the element 56 being guided in the slot 92.

The clamping portion 17 of the first jaw 14 is adjustable both normal to an parallel with the base 12 by means of an adjustment means. The adjustment means comprises a pair of transversely spaced Allen bolts 144. The bolts 144 extend through bores 146 in the body portion 16 of the first jaw 14 into threaded sockets 148 in the clamping portion 17 of the first jaw 14. A coil spring 150 is arranged co-axially with each of the bolts 144. By screwing the bolts 144 into the sockets 148 towards the clamping portion 17 against the action of the springs 150, the clamping portion 17 can be displaced parallel to the base to adjust the position of a workpiece (not shown) relative to the base.

The adjustment means further includes a screw-threaded stud 152 which projects from an upper surface of the body portion 16 of the first jaw 14. The stud 152 is screw-threadedly received in a threaded socket 154 in the body portion 16 of the first jaw 14. A nut 156 is provided on that portion of the stud 152 projecting from the body portion 16. The nut 156 bears against a washer 158 against a bearing surface 160 of the clamping portion 17 of the first jaw 14. By tightening the nut 156 on the stud 152, the nut bears against the washer 158 which in turns bears against the bearing surface 160 of the clamping portion 17 against the action of a pair of transversely spaced coil springs 162 provided in recesses 164 in the bottom of the clamping portion 17, the springs 162 bearing against the base 12. By manipulating the nut 156 and the bolts 144, the position of the clamping portion 17 relative to the body portion 16 and to the base 12 can be adjusted in the case where a workpiece is not perfectly square.

With the provision of a vice 10 as described above, a workpiece can be more radidly and securely gripped than with other vices of which the Applicant is aware.

I claim:

1. A vice which includes a base;

a first jaw projecting from the base, the first jaw having a body portion and a first clamping surface extending transversely to the base, the clamping surface of the first jaw being defined by a clamping portion which is displaceably attached to a body portion of the first jaw, the said clamping portion being displaceable both normal to, and parallel with, the base;

an adjustment means associated with the first jaw for facilitating displacement of the clamping portion of the first jaw, the adjustment means including a threaded bolt extending through a bore formed in the body portion of the first jaw into a threaded socket formed in clamping portion of the first jaw to facilitate displacement of the clamping portion parallel to the base;

a second jaw which comprises a body portion fast with the base, and a clamping portion, the second jaw clamping portion defining a second clamping surface aligned with, and opposed to the first clamping surface of the first jaw, the clamping portion and the body portion of the second jaw having substantially planar mating surfaces which define an inclined place along which the second jaw clamping portion can slide relative to the second jaw body portion, the inclined plane extending from the base in a direction away from the first jaw such that the spacing between the first and second clamping surfaces may be varied by displacing the second jaw clamping portion relative to the second jaw body portion; and a displacement means for exerting a displacing force on the second jaw clamping portion which is directed towards and substantially perpendicular to the base for displacing the clamping portion of the second jaw towards the base and thereby causing the second jaw clamping portion to be displaced toward the first jaw into an operative position in which a workpiece is securely gripped between the first clamping surface and the second clamping surface.

2. A vice as claimed in claim 1 in which the body portion of the second jaw is displaceably fast with the base, and in which which the body portion includes a locking means for locking the second jaw at a desired position on the base, the base having complementary locking formations with which the locking means of the body portion is releasably engageable.

3. A vice as claimed in claim 2, in which the locking means includes a pair of transversely spaced saw-tooth formations extending from the body portion of the second jaw towards the base, and in which the locking formations of the base include a pair of transversely spaced strips of complementary saw-tooth formations engageable by the saw-tooth formations of the body portion of the second jaw.

4. A vice as claimed in claim 3, in which the body portion of the second jaw includes a first urging means for urging the saw-tooth formations of the body portion of the second jaw out of engagement with the saw-tooth formations of the base.

5. A vice as claimed in claim 4, in which the base is elongate having a substantially centrally located channel extending longitudinal along the base intermediate the strips of saw-tooth formations.

6. A vice as claimed in claim 5, in which the displacement means includes an elongate bolt-like element having a head portion which is held slidably captive in the channel of the base, and a shank which extends from the head portion through aligned bores in the body portion and the clamping portion of the second jaw to project beyond the clamping portion of the second jaw, at least that portion of the shank projecting beyond the second jaw being screw-threaded with a nut received on the screw-threaded portion of the shank, the nut bearing via a washer on the clamping portion of the second jaw.

7. A vice as claimed in claim 6, in which the second jaw includes a second urging means for urging the clamping portion of the second jaw away from the base, the nut of the displacement means, in use, acting against the action of the second urging means to displace the clamping portion towards the base and into its operative position.

8. A vice as claimed in claim 5, in which the displacement means serves to urge the saw-tooth formations of the body portion of the second jaw into engagement with the strips of saw-tooth formations of the base against the action of the first urging means.

9. A vice as claimed in claim 3, in which the saw-tooth formations of the body portion of the second jaw and the strips of saw-tooth formations of the base are in the form of replaceable inserts.

10. A vice as claimed in claim 1, in which the adjustment means further includes a threaded stud, the longitudinal axis of which is arranged substantially normal to a longitudinal axis of the threaded bolt, the stud extending into a threaded bore formed in the body portion of the first jaw, and a nut bearing against a washer being screw-threadedly received on a free end of the stud projecting beyond the body portion, with the washer bearing against a bearing surface of the clamping portion against the action of a third urging means to facilitate the displacement of the clamping surfaces of the first jaw normal to the base.

11. A vice as claimed in claim 1, in which the body portion of the first jaw is formed integrally with the base.

* * * * *